US005653073A

United States Patent [19]

Palmer

[11] Patent Number: 5,653,073

[45] Date of Patent: Aug. 5, 1997

[54] FENESTRATION AND INSULATING CONSTRUCTION

[75] Inventor: Douglas Palmer, Mosinee, Wis.

[73] Assignee: SNE Enterprises, Inc., Mosinee, Wis.

[21] Appl. No.: 528,779

[22] Filed: Sep. 15, 1995

[51] Int. Cl.[6] ..... E06B 3/66

[52] U.S. Cl. ..... 52/204.593; 52/204.6; 52/204.62; 52/786.1; 52/788.1

[58] Field of Search ..... 52/204.593, 204.6, 52/204.62, 204.7, 208, 786.1, 786.13, 788.1

[56] References Cited

U.S. PATENT DOCUMENTS

| | | | |
|---|---|---|---|
| 309,636 | 12/1884 | Mann . | |
| 1,605,583 | 11/1926 | Heymer . | |
| 1,853,317 | 4/1932 | Packer . | |
| 2,029,541 | 2/1936 | Martinson . | |
| 2,050,733 | 8/1936 | Ross . | |
| 2,132,217 | 8/1938 | Neuendorf . | |
| 2,246,075 | 6/1941 | Phillips et al. . | |
| 2,607,453 | 8/1952 | Smith . | |
| 3,203,053 | 8/1965 | Lane et al. | 52/204.593 X |
| 3,573,149 | 3/1971 | Tibble et al. | 52/204.593 X |
| 3,881,290 | 5/1975 | Bouchey . | |
| 4,459,789 | 7/1984 | Ford | 52/786.1 X |
| 4,472,914 | 9/1984 | Deboef et al. . | |
| 4,615,159 | 10/1986 | Kessler | 52/204.593 X |

*Primary Examiner*—Robert Canfield
*Attorney, Agent, or Firm*—Gerald S. Geren

[57] ABSTRACT

There is provided by this invention an improved fenestration construction with an insulated glass pane construction. The fenestration can have a sash that includes an peripheral frame-like member which defines a central opening, an outer face and glazing engaging surfaces. A glazing engaging stop member constructed to cooperate with the peripheral frame-like member in forming the sash. A membrane which is gas and a moisture vapor flow resistant is applied to the glazing engaging surfaces. A primary and a secondary sealant is also applied to the membrane at the glazing engaging surfaces. The primary sealant is adjacent yet to-be-formed insulated space between the panes. The secondary seal is positioned outwardly thereof. An external pane is positioned in the sash and engages primary sealant and secondary sealant. A second pane is positioned in the sash space but generally parallel to the exterior pane and also engages sealant. The stop is then secured to the frame. The pane, sealants and membrane form an insulated space between the panes.

15 Claims, 3 Drawing Sheets

FIG. 2
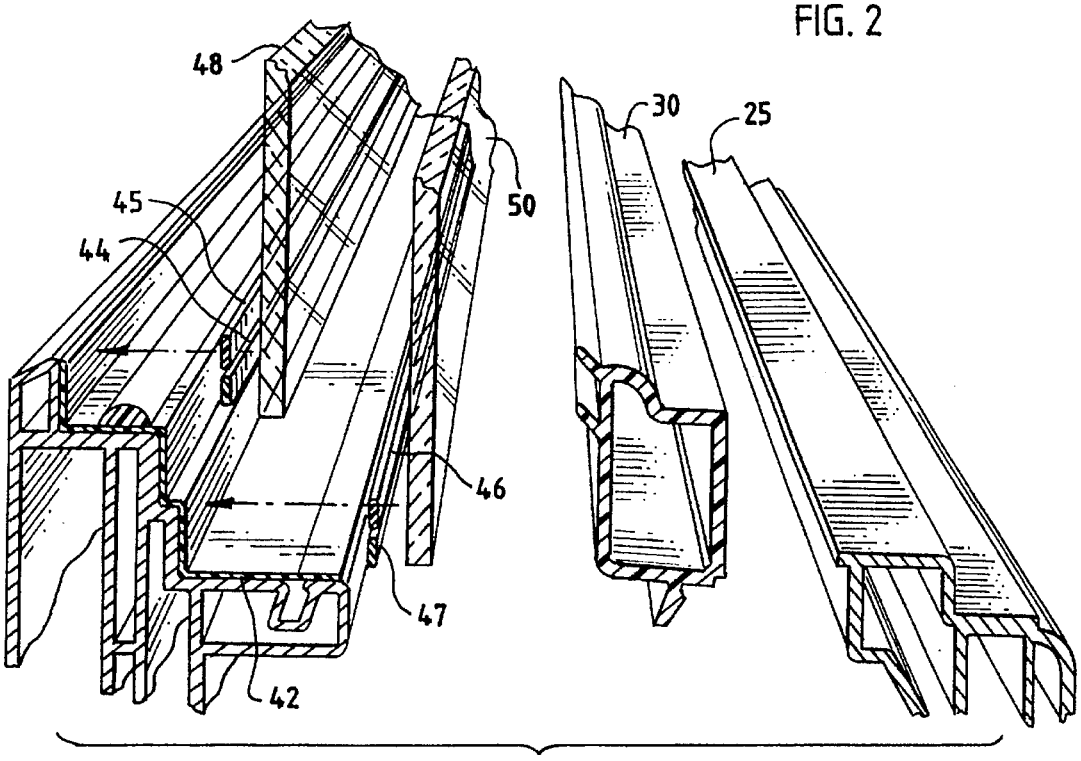
FIG. 3
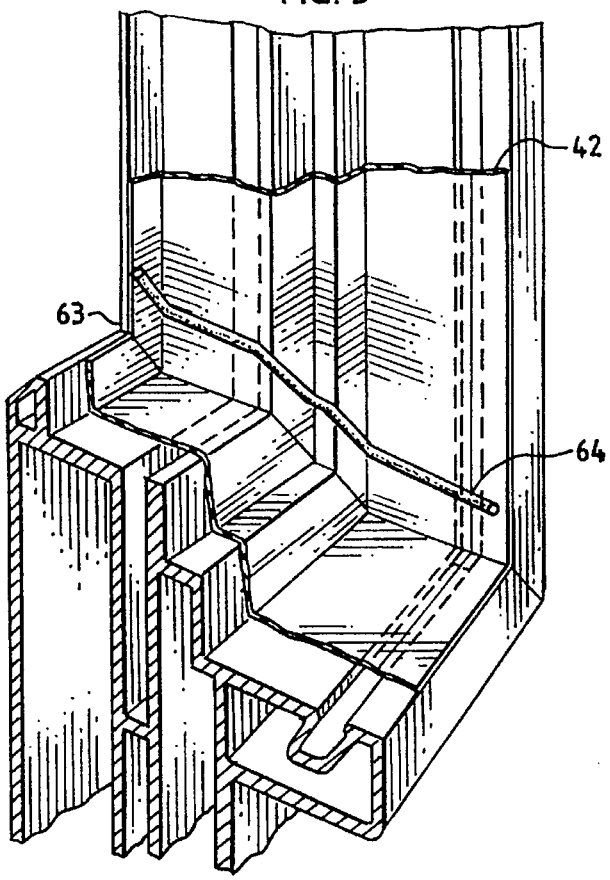
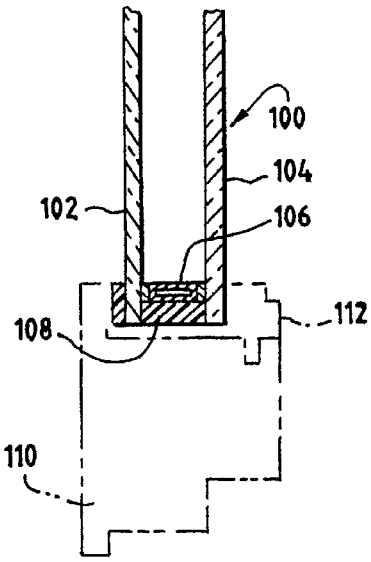
FIG. 4
PRIOR ART

FENESTRATION AND INSULATING CONSTRUCTION

BACKGROUND OF THE INVENTION

This invention relates to fenestration products and more particularly to a sash or jamb configuration for an insulation construction for such products.

A fenestration product is a door, window or skylight assembly that fits in a building opening. In such products it is common to provide a sash which frames or retains a transparent pane, usually glass. The sash can be thought of as a peripheral frame and, can be movable or stationary relative to a building frame mounted to a building and within which the sash is carried. In some situations there is no sash and the pane is set directly in the frame for the product. This is sometimes referred to as direct set. An example could be a picture window.

The pane is usually transparent and may be a single pane. However, due to temperature differentials between the external environment (outside of the pane) and the building interior, there may be heat losses. For example, in the winter the outside may be cold and the inside of the pane may be warm resulting in heat transfer from the inside to the outside as well as undesirable internal condensation. These heat loss and condensation issues can be a problem. In the summer time the losses may be in the opposite direction, where the inside is air conditioned and is cooler than the outside.

In order to avoid or minimize the heat loss and/or condensation problems, an insulating glass unit has been developed, wherein multiple spaced but parallel panes are sealed together to form a subassembly which is installed in the sash or frame. The space between the glass panes is insulated, sometimes filled with a gas and separates the inside and the outside panes. This spacing or insulation minimizes condensation and heat losses.

At the present time, the sealed insulating glass unit is separate and needs to be separately mounted in the sash or frame.

Reference is made to the application drawing FIG. 4 showing in section an insulating glass unit installed in a sash.

Usually, the unit is acquired from separate facilities or operations and needs to be installed in the sash or frame. But it is desirable (a) to manufacture the insulated glass unit with the sash or frame so as to minimize dimensional differences, which may occur as a result of units coming from different sources, (b) to assemble the elements together and (c) to more efficiently manufacture units.

Thus, it is an object of this invention to provide a sash or frame with an insulating glass construction which eliminates the separate insulating glass unit while still obtaining the benefits of the application.

Insulating glass systems where a pair of parallel panes are mounted in a sash can be seen in U.S. patents, such as U.S. Pat. Nos. 309,636; 1,605,583; 1,835,317; 2,029,541; 2,050,733; 2,132,217; 2,246,075; 2,607,453; 3,881,290; and 4,472,914.

These systems are believed not to be suitable in current manufacturing operations nor to effectively employ recent technology. For example, at the present extruded plastic materials are being used extensively.

Thus, another object of this invention is to employ a system which is more compatible with current technology.

The foregoing objects and other objects of this invention will become apparent from the following description and appended claims.

SUMMARY OF INVENTION

There is provided by this invention an improved insulating glass construction which employs this invention. The construction may employ extruded plastic, but the construction is not limited to an extruded plastic sash. The fenestration has glazing areas that include a peripheral frame which defines a central opening for receiving an outer pane and for receiving a inner pane in a position parallel to and spaced from the outer pane. The glazing area can be thought of as including peripheral ledges, steps or cut outs for receiving the spaced panes. A gas/moisture vapor impervious barrier or membrane is applied to the ledges so as to extend from the outer peripheral ledge to the inner peripheral ledge.

A strip of adhesive or sealant, as the primary sealant is applied to the barrier about the peripheral ledges so as to cooperate with the panes and seal the insulated glass space between the panes. The primary seal serves as a moisture vapor and gas barrier. A second adhesive is provided and is separated from the insulating space by the primary seal. The secondary seal provides substantial mechanical means for holding the glazing in place. In other words, the primary seal is adjacent to the insulating space and the secondary seal is separated from the insulating space.

The outer pane is placed on the outer ledge and engages the barrier surface, primary seal and secondary seal. The inner pane is then placed on the inner ledge and engages the barrier surface, primary seal and secondary seal. With respect to the space between the pane or insulated gas area, it is seen that the barrier surface, primary seals and secondary seals enclose and define a space which is sometimes filled with a preselected gas. A glazing stop is provided on the interior of the sash to hold the interior pane in place and finish the sash appearance.

The insulating glass unit can be thought of as the exterior pane, the membrane, the interior pane and the seals.

While the insulating unit usually has two panes the stepped ledge configuration permits multiple panes.

Using this system, the fabricator of the glazing frame can manufacture the frame sash and pane assembly with an insulating glass system. This system has been found to be effective from a heat transfer perspective and is useful with framing employing current technology. Moreover, this system has been found to eliminate components such as spacer channel and corner keys found in prior art constructions.

BRIEF DESCRIPTION OF THE DRAWINGS

FIG. 2 is an exploded view of the part of the system, showing glass panes to be mounted to the sash;

FIG. 3 is a perspective view of a corner of the system, showing a bead of sealant material applied at a corner of the sash;

FIG. 4 is a schematic view of a prior art system;

DESCRIPTION OF PREFERRED EMBODIMENTS

PRIOR ART

Figure 1:
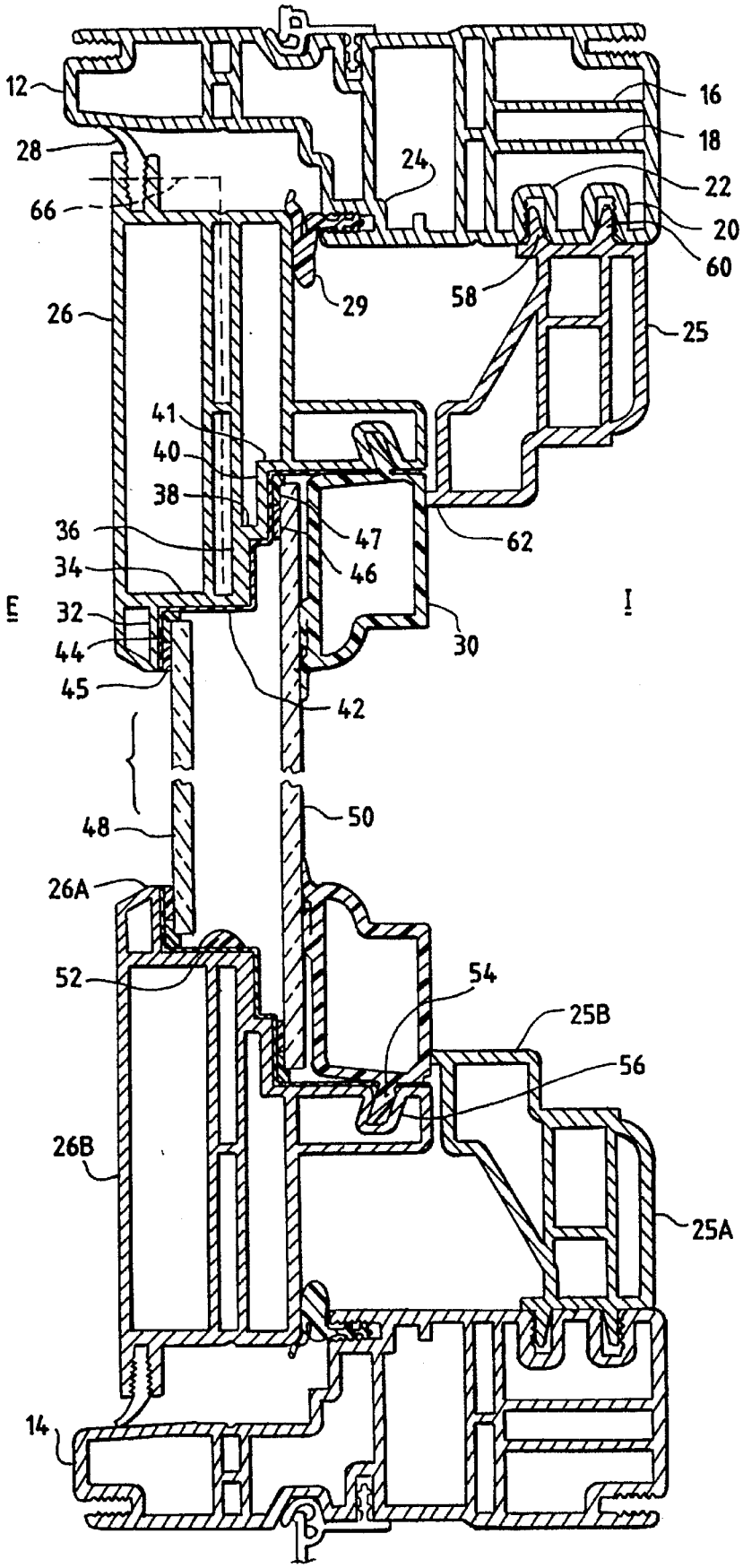
FIG. 1 is a horizontal section of a sash and insulating glass combination and includes a frame for a building.

Referring to FIG. 4, there is shown an insulated glass unit 100, which includes an outer pane 102, an inner pane 104 spaced therefrom, a metal separator spacer channel 106, which extends around the panes 102 and 104 and therebetween and an elastomeric sealant 108. This unit is assembled at a separate operation and delivered to the sash fabricator. A wooden sash 110 is shown in a section and shaped so as to receive the insulating glass unit 100. Thereafter the wooden stop 112 is applied thereto, so as to hold the insulating glass unit in position. The sash section 110 and 112 are fabricated from wood, vinyl or aluminum and are typical of the prior art.

A SASH EMBODIMENT

Referring now to FIG. 1, it is seen that a horizontal section through a typical window is taken. The vertical section includes substantially the same elements. It is seen that the sash sections are fabricated from an extruded plastic material. But the sash can be formed of many different materials such as extruded vinyl, foamed polyvinchloride, wood, metal, glass filled plastics, fiber glass and the like.

It is seen that there are provided building frame members 12 and 14 which are mounted to the building and within which the sash is positioned. A frame member such as 12 is an extruded plastic member having cavities, ribs and walls, which are positioned so as to accommodate strain and are used in fabrication. For example, internal walls such as 16 or 18 are provided as well as appropriate slots, such as 20, 22 and 24 for elements associated with the sash.

From the drawing, it is seen that the exterior or outside is identified by the letter "E" and the interior or inside is identified the letter "I".

An interior frame member 25 having an interior face 25A is secured to a frame such as 12.

The sash itself is an assembly formed of a member 26 and an interior stop member 30. The member forms a peripheral frame defining the central opening 26A which includes the pane retaining ledges and forms the exterior face 26B. It is seen that the building frame 12 and sash includes weather strips 28 and 29 that cooperate to seal the member 26 to the building frame 12. The member 26 provides a series of steps or ledge formations, such as 32, 34, 36, 38 40 and 41, which provide the support and positioning associated with an outer pane and an inner pane. The surfaces 32 and 34 can be thought of as the outer ledge. The surfaces 40 and 41 can be thought of as the inner ledge.

On the ledges there is applied a metalized plastic barrier or membrane 42, which may be a metal film on a plastic substrate construction, and is impervious or resistant to gas and moisture vapor flow thereacross. The barrier material is selected to prevent moisture from flowing into the insulated space and gas from flowing out of the insulated space. An example, is a currently available metalized balloon from which the interior gas flow to the exterior is minimized. The balloons may be polyester or Mylar which has been metalized. The barrier or membrane 42 which is applied along the surfaces 32, 34, 36, 38 40 and 41, may be a film which is applied to the sash, but the barrier can be integrally formed with the sash by extrusion. This membrane in association with the other components defines the seal for the space between the panes.

A pair of primary seals, such as 44 or 46 are each provided along the corner of a ledge, such as at 32 and 34 40 and 41. These seals adhere to the barrier or membrane 42. The outer pane 48 is positioned against the seal 41 and seals thereagainst to provide a gas tight joint at that point. The inner pane 50 is fitted to seal 46, so as to again provide a gas tight joint. It is to be noted that the primary seal is adjacent to the space between the panes.

The primary seal can be fabricated of a material known as polyisobutylene, which has very good sealing properties. The secondary seals 45 and 47 are sometimes referred to as the glazing bedding and may be in the form of a silicone or butyl. The secondary seals are outward of the primary seal with respect to the insulating space. In other words, the primary seals are adjacent to the insulating space and separate the secondary seal and insulating space. A desiccant, in a form of an extruded bead or tape, such as 52 is applied to the barrier or membrane and is intended to remove moisture from the insulated glass or space between the inner pane and outer pane.

It will be appreciated that the glass "is laid up" with the sash member 26 in a horizontal, laid down or inclined position so as to expose the ledges.

Thereafter, the stop 30 is applied to the sash and inner pane 50. It is seen that the stop 30 includes a tab 54, which cooperates with a slot formation 56 in the member 26. In this condition, the stop acts to hold the interior pane in place and is positioned between the exterior surface of the exterior member 26 and the surface 25A of the inner member 25. The stop is shown as an extruded plastic member but can be of other materials such as wood.

The inner member 25 with surfaces 25B and 25A is secured in position against the frame 12 by the tabs 58 and 60 which engage the slots 20 and 22 in the frame. It is also seen that the inner member 25 terminates in a shoulder formation 62 whereby the inner member engages and holds the stop in position against the pane 50. Thus, the sash in a sense is made up of the member 26 and stop 30. The insulating glass unit is formed by the panes 48 and 50, membrane 42, primary sealant 44 and 46 and secondary seals 45 and 47.

FIG. 2 shows an exploded view of the sealant system showing the panes 48 and 50 and the relationship between the panes 48 and 50, the barrier or membrane 42 and the seals 44, 45, 46 and 47.

Referring now to FIG. 3, it is seen that vertical and horizontal portions of the sash (stiles and rails) are joined at a corner. However, when such a system is formed at the corner, it is possible that the barrier or membrane 42 may not be at completely sealed at the corner joint 63. Separation can be caused by cutting or mitering of the vertical and horizontal pieces of the sash or frame. To prevent or minimize gas leakage and moisture vapor transmission at the joint, a bead 64 of sealant material is placed along the corner. The sealant material is the same material as the primary seal 46 and usually is polyisobutylene.

It is believed that with the foregoing system, an air tight insulating glass system is provided, whereby the gas is prevented from flowing externally of the space between the panes by the membrane and is appropriately sealed. Similarly exterior moisture or vapor cannot flow into the insulated space.

Sometimes, it is desirable to permit the insulating glass unit to "breath" in the event of changes in the atmospheric pressure. In other words, the insulating space should be at the ambient pressure. Thus, an appropriate breather tube is provided and that tube is usually provided along the dashed line 66 in FIG. 1. The breather tube is sealed where it enters the insulated spaced, with polyisobutylene and is crimped closed at its exterior end. The crimping permits the tube to be opened to balance pressure differences between the space between the panes (which may have been filled at seal level) and a higher altitude of use, and to be recrimped. A similar tube is provided for filling of the insulated space with a preselected gas. This tube is sealed at its insertion point with a polyisobutylene so as to prevent leakage from the space at barrier.

A DIRECT SET EMBODIMENT

Figure 5:
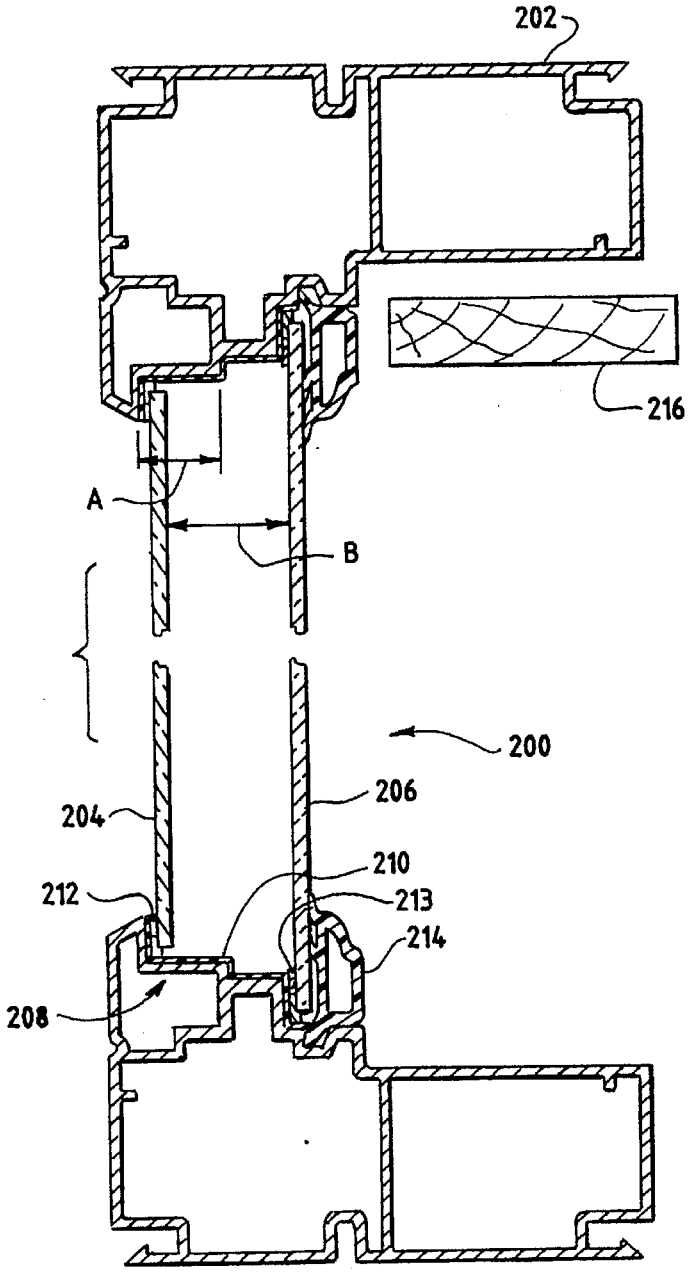
FIG. 5 is a horizontal section of a direct set product showing another example of an improved assembly.

Referring now to FIG. 5 a direct set embodiment 200 is shown. In that embodiment there is only one frame 202 and the outer pane 204 and inner pane 206 are set directly in that frame. The direct set embodiment includes an insulation construction including the ledges 208, barrier 210 and seals such as 212 and 213, as previously discussed. Similarly a stop 214 is provided which cooperates with the frame 202 to retain the inner space 206. For decorative purposes wood cladding or sheathing such as 216 can be applied to a frame as in FIG. 5 or a sash system as in FIG. 2.

THE INSULATING SPACE, THE LEDGES AND THE STOP

The space between the panes can be filled with various gases such as air, carbon dioxide, sulfur hexafloride, argon, krypton or xenon. It has been found that each of these gases are most effective when the panes are spaced apart at selected distances. For example krypton is best when the panes are about ⅜ inch apart and argon is effective when the panes are about ½ inch apart.

In order to accommodate the difference the ledges are stepped so as to define such distances. For example, in FIG. 5, the distance "A" from the outer ledge to a center ledge may be ⅜ inch and the distance "B" from the outer pane to the inner pane may be ½ inch. In order to accommodate the smaller gap or space between the panes, the inner pane 206 is made smaller and sealed against the center ledge.

Figure 6:
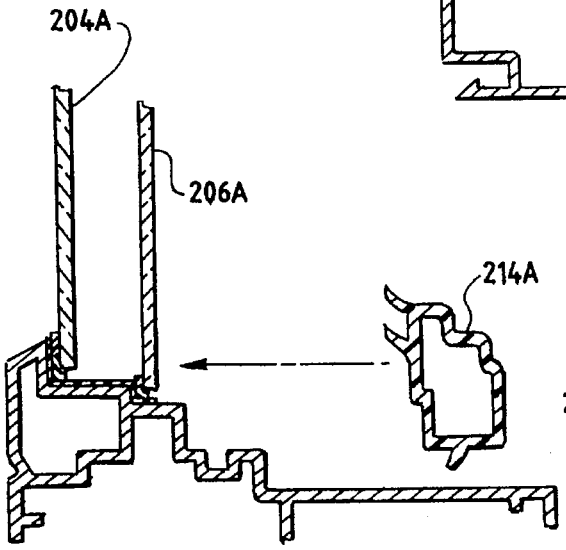
FIG. 6 is a vertical section that shows a stepped glazing stop member.

In FIG. 6, there is also shown a fragmentary construction where the outer pane 204A is against an outer ledge and the inner pane 206A is inwardly against the center ledge. The shape of the stop 214A has been adjusted or stepped to accommodate the thickness between pane and the ledge or steps which are to be engaged. In other words, the stop has a stepped profile to match the ledges and permit it to engage the inner pane.

THE MULTIPLE PANE CONSTRUCTION

Figure 7:
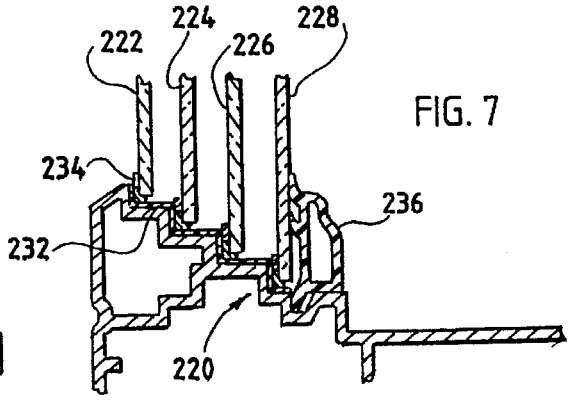
FIG. 7 is a vertical section that shows a series of ledges with several panes thereon.

Referring now to FIG. 7 a construction having a step or ledge formation 220 is shown. In that construction four (4) panes 222, 224, 226, and 228 are shown each supported on a ledge. This embodiment includes a barrier 232, seal 234 and a stop 236 as in the other embodiments.

This construction provides for multiple gas spaces. In a usual embodiment there may be between 1 and 3 spaces (i.e. 2 to 4 panes). However, with this system multiple panes and spaces can be provided.

It will be appreciated that numerous changes and modifications can be made to the above-descried embodiment without departing from the spirit and scope of this invention.

I claim as my invention:

1. An improved fenestration and insulating construction comprising:

a peripheral frame-like member which defines a central opening and a step-like ledge formation having a plurality of spaced pane receiving- and- retaining surfaces adjacent said central opening;

an external pane fitted within the opening and positioned to be received and retained by one of the pane receiving-and-retaining surfaces;

an internal pane fitted within the opening, spaced from and substantially parallel to the external pane so as to define an internal insulating space therebetween and positioned to be received and retained by another of the pane receiving-and-retaining surfaces;

said peripheral frame defining insulating-space surfaces associated with the insulating space;

a gas and moisture impervious barrier layer on said pane receiving-and-retaining surfaces and on the insulating surfaces for inhibiting gas and moisture flow across said layer and said layer in contiguous relation with the insulating space;

a primary sealant positioned between the barrier layer and each pane, said sealant engaging each pane and said barrier layer and said primary sealant being contiguous with the insulating space between the panes;

a secondary sealant positioned between the barrier layer and each pane, said sealant engaging said pane and said barrier layer and separated from the insulating space between the panes by the primary sealant;

so that the panes, barrier layer primary sealant and secondary sealant define an insulating unit.

2. An improved fenestration as in claim 1 wherein the peripheral frame like member defines a sash.

3. An improved fenestration as in claim 1 wherein the peripheral frame like member defines a frame for a direct set unit.

4. An improved fenestration as in claim 1 wherein there are provided two ledges for engaging said interval and said external panes.

5. An improved fenestration as in claim 1 wherein there is provided three or more ledges constructed to retain and support at least an internal pane, an external pane and a central pane.

6. An improved fenestration as in claim 5 wherein the internal and external panes can be selectively positioned on ledges associated with the fenestration.

7. An improved fenestration as in claim 1 wherein the space between the internal and the external pane is filled with a gas.

8. An improved fenestration as in claim 7 wherein the gas is selected based upon the distance between the panes.

9. An improved fenestration as in claim 1 wherein said barrier layer comprises a metalized plastic layer.

10. An improved fenestration as in claim 9 wherein the layer is a polyester film which has been metalized.

11. An improved fenestration as in claim 1 wherein the peripheral frame like member is constructed of a multi-chambered vinyl extrusion.

12. An improved fenestration as in claim 1 wherein the primary seal consists essentially of polyisobutylene.

13. An improved fenestration as in claim 1 wherein there is provided a breather tube which extends from the space between the panes to a position external thereof.

14. An improved fenestration as in claim 1 wherein each pane is of transparent glass.

15. An improved fenestration as in claim 1 wherein said internal pane and said external pane are dimensionally different from one another.

* * * * *